US011166611B2

(12) United States Patent
Li

(10) Patent No.: US 11,166,611 B2
(45) Date of Patent: Nov. 9, 2021

(54) CLEANING ROBOT AND ROLLER CLEANING DEVICE

(71) Applicant: HiZero Technologies Co., Ltd., Shenzhen (CN)

(72) Inventor: Yang Li, Guangdong (CN)

(73) Assignee: HIZERO TECHNOLOGIES CO., LTD., Shenzhen (CN)

( * ) Notice: Subject to any disclaimer, the term of this patent is extended or adjusted under 35 U.S.C. 154(b) by 512 days.

(21) Appl. No.: 16/303,200

(22) PCT Filed: Feb. 13, 2018

(86) PCT No.: PCT/CN2018/076724

§ 371 (c)(1),
(2) Date: Nov. 20, 2018

(87) PCT Pub. No.: WO2019/157662

PCT Pub. Date: Aug. 22, 2019

(65) Prior Publication Data

US 2021/0259500 A1 Aug. 26, 2021

(51) Int. Cl.
*A47L 11/40* (2006.01)
*A47L 11/292* (2006.01)

(52) U.S. Cl.
CPC ..... *A47L 11/4041* (2013.01); *A47L 11/292* (2013.01); *A47L 11/4016* (2013.01);
(Continued)

(58) Field of Classification Search
CPC A47L 11/4041; A47L 11/292; A47L 11/4016; A47L 11/4027; A47L 11/4083; A47L 11/4088; A47L 2201/00
See application file for complete search history.

(56) References Cited

U.S. PATENT DOCUMENTS 10,022,032 B1 * 7/2018 Li ..... A47L 11/302
10,039,431 B1 8/2018 Li et al.
(Continued)

FOREIGN PATENT DOCUMENTS

CN 2894588 Y 5/2007
CN 201814516 U 5/2011
(Continued)

OTHER PUBLICATIONS

Corresponding Great Britain Patent Application No. GB1819622.0, Combined Search and Examination Report dated Apr. 30, 2019.
(Continued)

*Primary Examiner* — Dung Van Nguyen

(57) ABSTRACT

The present disclosure discloses a cleaning robot and a roller cleaning device thereof. The cleaning robot comprises a shell and a roller cleaning device. The roller cleaning device comprises a flexible roller, a roller motor for driving the flexible roller to rotate, a water sink close to and in communication with a surface of the flexible roller, a water tank, and a sewage pressing member. The water tank comprises a filter member. One end of the water sink is in communication with the water tank through a sewage pipe at a position above the filter member, and the other end of the water sink is in communication with a clean water pipe at a position below the filter member. The water tank is connected to a vacuum pump, and the sewage pressing member squeezes the sewage in the flexible roller into the water tank when the flexible roller rotates.

16 Claims, 5 Drawing Sheets

(52) U.S. Cl.
CPC ..... *A47L 11/4027* (2013.01); *A47L 11/4083* (2013.01); *A47L 11/4088* (2013.01); *A47L 2201/00* (2013.01)

(56) References Cited

U.S. PATENT DOCUMENTS

| | | | | |
|---|---|---|---|---|
| 2003/0014829 | A1 | 1/2003 | Wang | |
| 2016/0058258 | A1* | 3/2016 | Isley | A47L 9/0455 15/50.1 |
| 2016/0278597 | A1* | 9/2016 | Braendle | A47L 9/322 |
| 2018/0206689 | A1 | 7/2018 | Li et al. | |

FOREIGN PATENT DOCUMENTS

| | | | |
|---|---|---|---|
| CN | 103356137 | A | 10/2013 |
| CN | 205181250 | U | 4/2016 |
| CN | 105795995 | A | 7/2016 |
| CN | 107252286 | A | 10/2017 |
| CN | 107320007 | A | 11/2017 |
| EP | 3238597 | A1 | 11/2017 |
| EP | 3284383 | A2 | 2/2018 |
| JP | S58151411 | Y | 10/1983 |
| JP | H5184334 | A | 7/1993 |
| JP | H0671119 | A | 3/1994 |
| JP | 2000197796 | A | 7/2000 |
| JP | 2000343088 | A | 12/2000 |
| JP | 2001293636 | A | 10/2001 |
| JP | 2005288837 | A | 10/2005 |
| WO | 2017059600 | A1 | 4/2017 |
| WO | 2018024125 | A1 | 2/2018 |

OTHER PUBLICATIONS

Corresponding European patent application No. 18209650.3, European Search Report dated Jul. 12, 2019.
Corresponding Japanese Patent Application No. 2019-519734, Office Action dated Jun. 24, 2020, English Translation.

* cited by examiner

CLEANING ROBOT AND ROLLER CLEANING DEVICE

FIELD OF THE DISCLOSURE

This disclosure relates to the technical field of cleaning equipment, in particular to a cleaning robot and a roller cleaning device thereof.

BACKGROUND OF THE DISCLOSURE

A cleaning robot is an automatic cleaning device that reduces the pressure on people to clean. The cleaning robot generally adopts the structure of a roller brush, a roller, a sewage sink, a clean water tank, and a sewage tank. The clean water is supplied from the one end of the sewage sink to the roller, and sewage squeezed from the roller is absorbed into the sewage tank through negative pressure. The sewage in the sewage tank is directly discharged. On the one hand, the discharged sewage causes environmental pollution, and on the other hand, it also causes waste of water resources.

SUMMARY OF THE DISCLOSURE

Based on this, it is necessary for the present disclosure to provide a roller cleaning device that recycles water and saves resources.

The present disclosure also provides for a cleaning robot.

In order to achieve the object of the present disclosure, the present disclosure adopts the following technical solutions:

A roller cleaning device comprising a flexible roller, a roller motor for driving the flexible roller to rotate, a water sink close to and in communication with a surface of the flexible roller, a water tank, and a sewage pressing member, wherein the water tank is provided with a filter member. One end of the water sink communicates with the water tank at a position above the filter member through a sewage pipe, and the other end of the water sink communicates with the water tank through a clean water pipe at a position below the filter member. The water tank is connected to a vacuum pump. The sewage pressing member squeezes the sewage in the flexible roller into the water sink when the flexible roller rotates.

In the above-mentioned roller cleaning device, the water sink is connected to the water tank, and a filter member is arranged in the water tank. The sewage flows from the water sink into the upper part of the water tank, is filtered by the filter member to become clean water, and then re-enters the water sink to flush the flexible roller, thereby achieving water recycling, which saves water resources and also reduces environmental pollution. In some embodiments, the filter member includes an outer filter mesh, a suction member mounted in the outer filter mesh, and a drain pipe connected to the suction member. An outer wall of the outer filter mesh is connected to an inner wall of the water tank. The sewage pipe and the clean water pipe are both connected to the outer filter mesh. The drain pipe extends out of a lower end of the outer filter mesh and extends out of the water tank. The connection between the drain pipe and the water tank has a sealing member.

In some of these embodiments, the suction member is a sponge, activated carbon, zeolite, or resin. In some embodiments, the inner wall of the water tank is provided with a serrated water tank protrusion, and the outer wall of the filter member is provided with a serrated filter protrusion. The filter protrusion is rotatable along the water tank protrusion to adjust the installation location of the filter member. In some embodiments, the water sink includes a clean water sink and a sewage sink. A bottom of the clean water sink is provided with a clean water hole, and a bottom of the sewage sink is provided with a sewage hole. The clean water sink communicates with the clean water pipe, and the sewage sink communicates with the sewage pipe. In some of the embodiments, the sewage sink is spaced apart from the clean water sink. In some of the embodiments, the clean water sink is disposed above the flexible roller, the sewage sink is disposed adjacent to the clean water sink, and the sewage pressing member is disposed adjacent to the sewage sink.

In some embodiments, the sewage sink is disposed above the flexible roller, and the clean water sink is disposed above the sewage sink and connected to the sewage sink. The sewage pressing member is connected to a drive component. A clean water electromagnetic valve is disposed on the clean water pipe, and the sewage pipe is provided with a sewage electromagnetic valve, wherein the clean water electromagnetic valve, the sewage electromagnetic valve, and the drive component are electrically connected to a controller. The controller controls the clean water electromagnetic valve to open at alternate intervals relative to the sewage electromagnetic valve and the drive component. In some embodiments, the sewage pressing member is a water pressing roller, the water pressing roller is disposed adjacent to the water sink, and a center of the water pressing roller is disposed in parallel with a center of the flexible roller. The surface of the water pressing roller is pressed against the surface of the flexible roller, and the water pressing roller presses the sewage in the flexible roller into the sewage sink when the flexible roller rotates. It is also a need of the present disclosure to provide a cleaning robot that includes the roller cleaning device.

BRIEF DESCRIPTION OF THE DRAWINGS

In order to more clearly explain the embodiments of the present disclosure or the technical solutions relative to the prior art, the drawings to be used in the description of the embodiments or the prior art will be briefly described below. Obviously, the drawings in the following description are only some embodiments of the present disclosure. For those skilled in the art, drawings of other embodiments can also be obtained based on these drawings without any creative work.

DETAILED DESCRIPTION OF THE EMBODIMENTS

To facilitate the understanding of the present disclosure, the present disclosure will be described more fully hereinafter with reference to the accompanying drawings. The preferred embodiments of the disclosure are given in the accompanying drawings. However, the present disclosure may be embodied in many different forms and is not limited to the embodiments described herein. Rather, these embodiments are provided so that this disclosure will be thorough and complete. It should be noted that when an element is referred to as being "fixed" to another element, it may be directly on the other element or there may also be an intervening element. When an element is considered to "connect" another element, it can be directly connected to another element or there may be an intervening element. Unless otherwise defined, all technical and scientific terms used herein have the same meaning as commonly understood by one of ordinary skill in the art to which this disclosure belongs. The terminology used in the description of the present disclosure herein is for the purpose of describing particular embodiments only and is not intended to limit the present disclosure.

Embodiment 1

Figure 1:
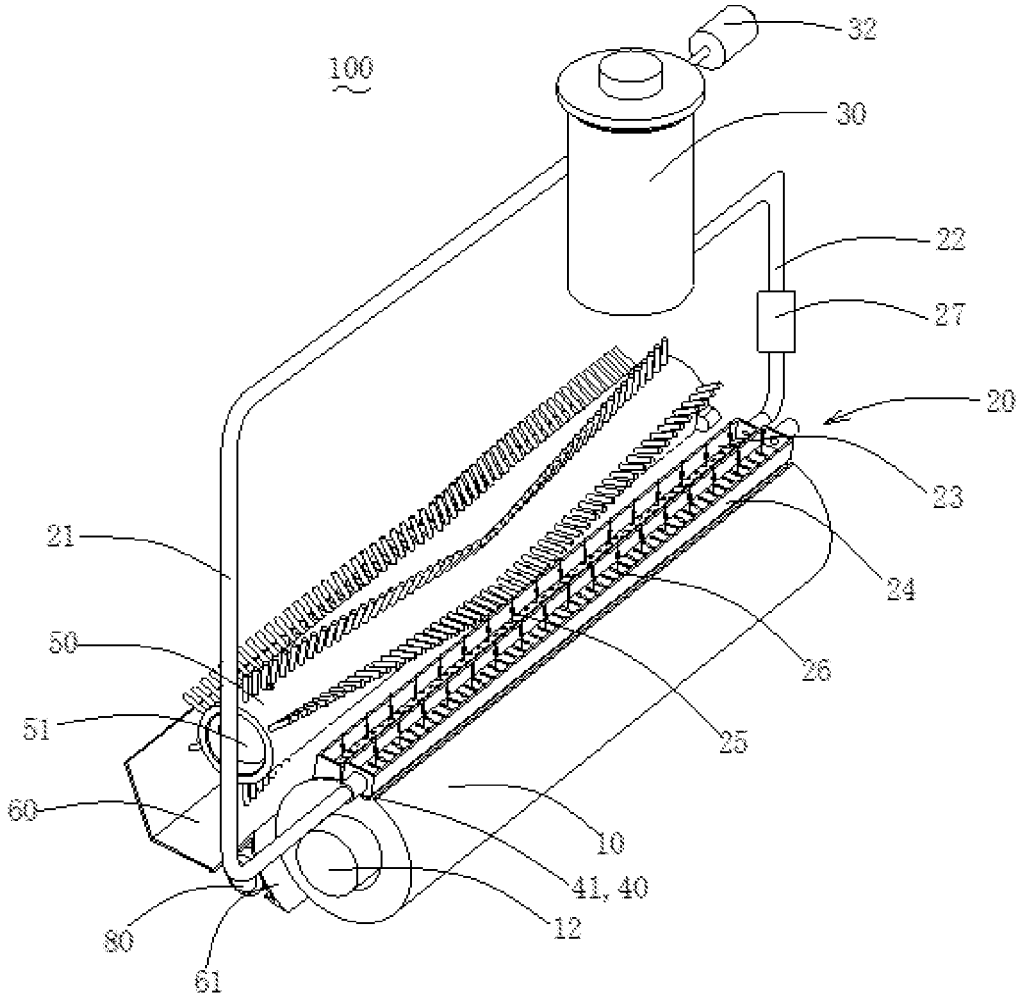
FIG. 1 is a schematic view showing the overall structure of a roller cleaning device according to a preferred embodiment of the present disclosure.
Figure 2:
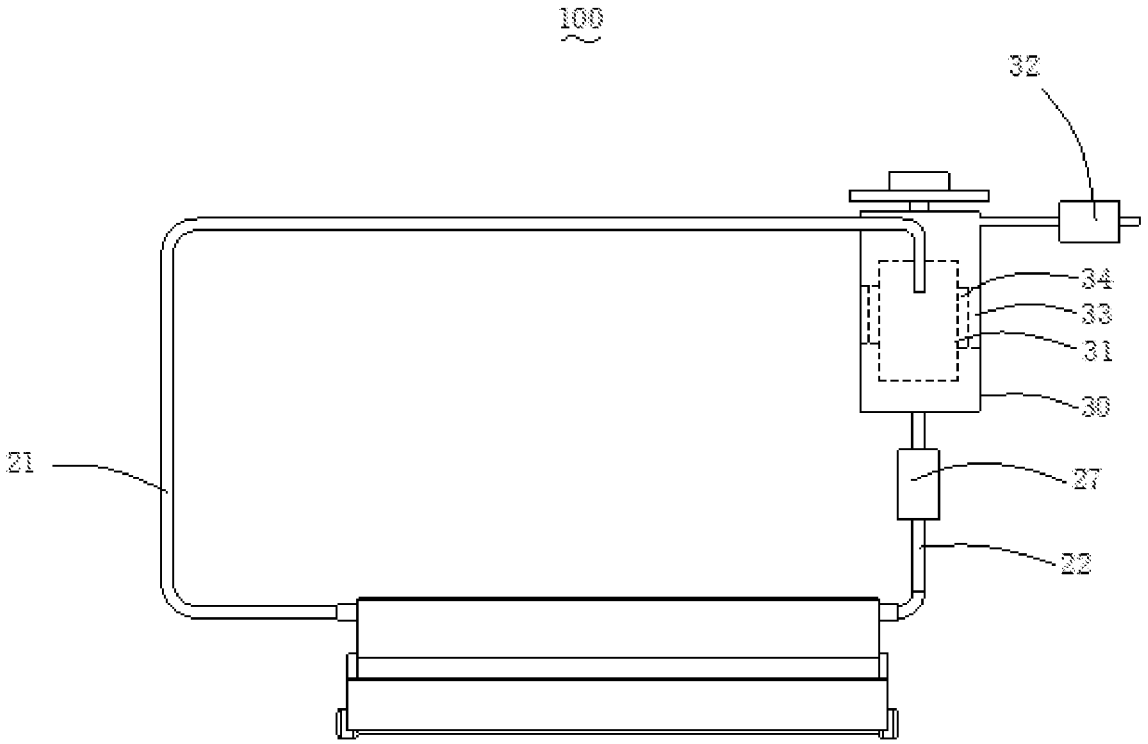
FIG. 2 is a schematic view of another perspective of the roller cleaning device of FIG. 1.
Figure 3:
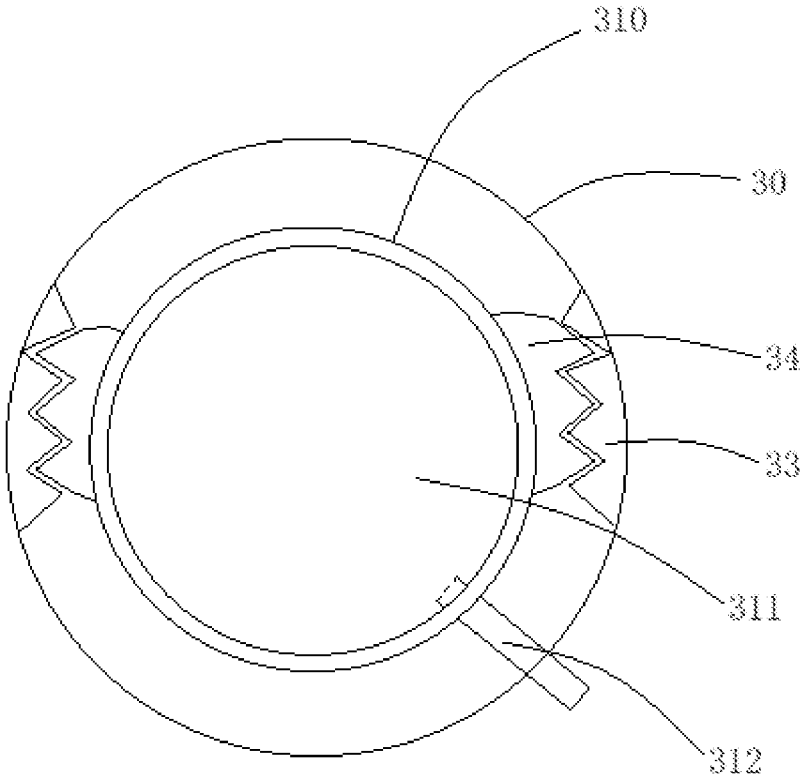
FIG. 3 is a schematic diagram of the internal structure of the water tank of the roller cleaning device according to another preferred embodiment of the present disclosure.

Referring to FIG. 1 to FIG. 3, a cleaning robot according to a preferred embodiment of the present disclosure includes a shell and a roller cleaning device 100 located in the shell. The roller cleaning device 100 includes a flexible roller 10, a roller motor 12 that drives the flexible roller 10 to rotate, a water sink 20 close to and in communication with a surface of the flexible roller 10, a water tank 30 in communication with the water sink 20, a sewage pressing member 40 for pressing the flexible roller 10, a roller brush 50 located on one side of the flexible roller 10 and contacting the flexible roller 10, and a garbage collection box 60 located below the roller brush 50.

When the flexible roller 10 rotates, dirt on the ground is are removed. A filter member 31 is disposed in the water tank 30. One end of the water sink 20 is connected with the water tank 30 at a position above the filter member 31 through a sewage pipe 21, and the other end of the water sink 20 is connected with the water tank 30 at a position below the filter member 31 through the clean water pipe 22. The sewage pressing member 40 squeezes the sewage in the flexible roller 10 into the water sink 20 when the flexible roller 10 rotates. The water tank 30 is connected to a vacuum pump 32. The vacuum pump 32 supplies power to suction the sewage from the water sink 20 into the water tank 30, and the sewage entering the water tank 30 is filtered to become clean water to be supplied to the flexible roller 10.

A rotating shaft of the flexible roller 10 is made of a hard material, and a peripheral portion is made of a flexible material, for example, made of a sponge, a cotton cloth or the like, so that the water is easily absorbed therein, and the cleaning function is easily achieved. The flexible roller 10 is driven to rotate by the roller motor 12, and the roller motor 12 is also mounted inside the shell. The rotation speed of the flexible roller 10 affects the cleaning ability, so it is necessary to appropriately set the rotation speed of the flexible roller 10. Different speeds are used when cleaning different environments.

Referring to FIG. 1, the water sink 20 can separately provide for receiving the clean water and sewage. In this embodiment, the water sink 20 includes a clean water sink 23 and a sewage sink 24, and a clean water hole 25 is provided at the bottom of the clean water sink 23. The bottom of the sewage sink 24 is provided with a sewage hole 26. A clean water sink 23 is connected to the clean water pipe 22, and the sewage sink 24 connected to the sewage pipe 21. A clean water pump 27 is also disposed on the clean water pipe 22 to provide pressure for the clean water entering into the water sink 20.

The sewage sink 24 is disposed separately from the clean water sink 23. When the flexible roller 10 rotates, the clean water sink 23 supplies clean water thereto. The sewage pressing member 40 is used for pressing the sewage out of the flexible roller 10 and into the sewage sink 24 to achieve the purpose of collecting sewage.

In this embodiment, the clean water sink 23 is disposed above the flexible roller 10 and is spaced apart from the flexible roller 10 by a gap. The bottom of the clean water sink 23 is provided with an array of clean water holes 25, and water inlets are provided on both sides of the clean water sink 23. The water inlets are connected to the water tank 30, and water can be introduced through the two water inlets. Of course, it is also possible to include only one water inlet or to control the water intake by providing an electromagnetic valve at the two water inlets. The sewage sink 24 is disposed near the clean water sink 23. There is a gap between the sewage sink 24 and the clean water sink 23, so that the volume of the entire roller cleaning device 100 can be reduced, and the bottom of the sewage sink 24 is provided with an array of sewage holes 26. Water outlets are arranged at both ends of the sewage sink 24. The water outlets are connected to the sewage sink, and the sewage can be separately discharged through the two water outlets. Of course, it is also possible to include only one water outlet or to control the amount of sewage output by providing an electromagnetic valve at the two water outlets. When sewage accumulates in the sewage sink 24, it can be discharged to the water tank 30 through the water outlet.

Referring to FIG. 2 and FIG. 3, the filter member 31 in the water tank 30 functions to filter the sewage to remove the waste and to become fresh water that can be reused. In this embodiment, the filter member 31 includes an outer filter mesh 310, a suction member 311 installed in the outer filter mesh 310, and a drain pipe 312 connected to the suction member 311. The outer wall of the outer filter mesh 310 is connected to the inner wall of the water tank 30. The sewage pipe 21 and the clean water pipe 22 are both connected to the outer filter mesh 310. The drain pipe 312 extends out of the lower end of the outer filter mesh 310 and extends out of the water tank 30. The connection between the drain pipe 312 and the water tank 30 has a sealing member. When the filter member 31 is operated, water is filtered into the filter member 31, and the clean water is discharged from the clean water pipe 22. The drain pipe 312 can discharge dirt in the suction member 311 to prevent clogging and the loss of filtering.

The suction member 311 is a sponge, activated carbon, zeolite, resin, or the like. Further, the inner wall of the water tank 30 is provided with a serrated water tank protrusion 33, and the outer wall of the filter member 31 is provided with a serrated filter protrusion 34, and the filter protrusion 34 is rotatable along the water tank protrusion 33 to adjust the installation of the filter member 31 position. The material of the water tank protrusion 33 and the filter protrusion 34 may be elastic materials such as plastic. Referring to FIG. 1, in the present embodiment, the sewage pressing member 40 is a water pressing protrusion 41 provided at the bottom of the sewage sink 24.

Figure 4:
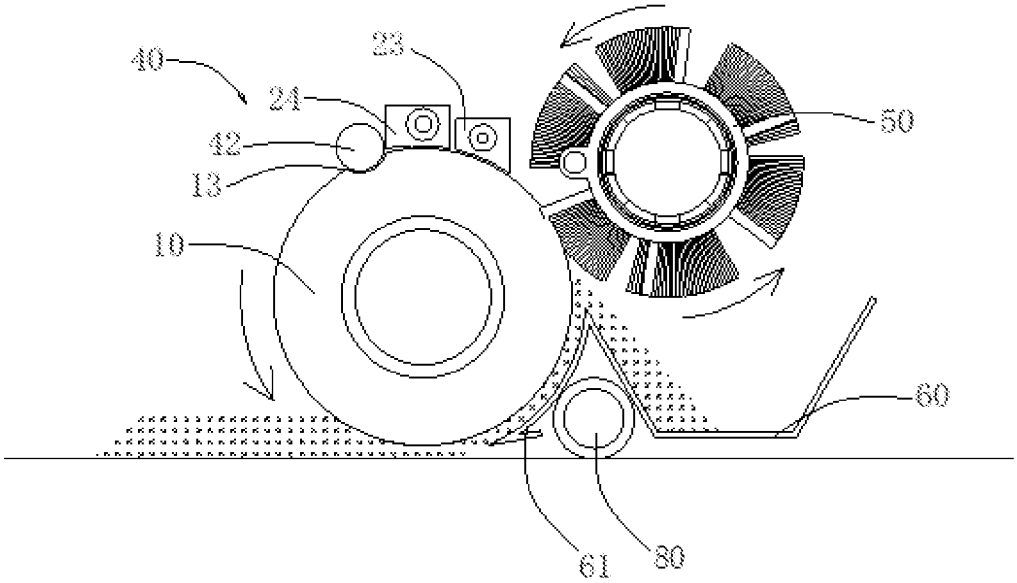
FIG. 4 is a schematic structural view of a roller cleaning device according to another preferred embodiment of the present disclosure, in which the water tank, the sewage pipe, and the clean water pipe are removed.

Referring to FIG. 4, in other embodiments, the sewage pressing member 40 may further be a water pressing roller 42 having a cylindrical shape, and the water pressing roller 42 is disposed adjacent to the sewage sink 24 to facilitate pressing the sewage into the sewage sink 24. The surface of the water pressing roller 42 is pressed against the surface of the flexible roller 10.

In the present embodiment, there is a gap between the water pressing roller 42 and the side surface of the sewage sink 24. The water pressing roller 42 presses the flexible roller 10 so that the surface of the flexible roller 10 forms a depressed portion 13, and the portion of the water pressing roller 42 located in the depressed portion 13 is one-fourth to one-half of the size of the water pressing roller 42. This will not affect the normal rotation of the flexible roller 10, but can squeeze out the sewage. Of course, when the size of the portion of the water pressing roller 42 in the depressed portion 13 is large, the flexible roller 10 can also be rotated. In the present embodiment, the portion of the water pressing roller 42 located at the depressed portion 13 has a size of one-third of the size of the water pressing roller 42, which is the optimum press down size.

The water pressing roller 42 is made of a hard material to facilitate the pressing of the flexible roller 10. For example, the aforementioned object can be achieved when the water pressing roller 42 is made of a wood material, a plastic material, a metal material, or the like. The water pressing roller 42 is mounted in the shell, for example, connected to the shell, or mounted in the shell near the sewage sink 24 by a mounting bracket. It can be understood that the number of water pressing rollers 42 may be one or more, and a plurality of water pressing rollers 42 may be disposed without affecting the normal operation of the roller cleaning device 100. In the present embodiment, the number of water pressing rollers 42 is one, and the water pressing roller 42 and the roller brush 50 are respectively located on both sides of the sewage sink 24 and the clean water sink 23.

Referring to FIG. 1, the garbage collection box 60 is located at one side of the flexible roller 10 and directly under the roller brush 50. One side of the garbage collection box 60 abuts the flexible roller 10 so that the garbage brushed on the flexible roller 10 can be dropped into the garbage collection box 60. The garbage collection box 60 is U-shaped, but the corners are arranged in a square shape.

Further, a scraper 61 is provided on the side of the garbage collection box 60 close to the flexible roller 10 for scraping the garbage on the flexible roller 10. A load bearing wheel 80 is disposed between the garbage collection box 60 and the scraper 61 for increasing the load bearing capacity of the garbage collection box 60. The scraper 61 is disposed in an are shape and has one end connected to one side of the garbage collection box 60 abutting the flexible roller 10.

Embodiment 2

The roller cleaning device of this embodiment differs from the first embodiment in that the suction member 311 of the filter member 31 sequentially includes an activated carbon layer, a resin layer, and a zeolite layer from the outer layer to the inner layer, and the drain pipe 312 communicates with the suction member 311.

Embodiment 3

The roller cleaning device of this embodiment differs from the first embodiment in that the clean water sink 23 is disposed above the flexible roller 10, the sewage sink 24 is disposed near the bottom of one side of the flexible roller 10, and the top of the sewage sink 24 is enclosed. A sewage hole is provided at the bottom of the sewage sink 24. This makes the sewage sink 24 closer to the area where the sewage is concentrated, which makes it easier to drain the sewage. At this time, the sewage pressing member 40 is a water pressing protrusion 41 provided at the bottom of the sewage sink 24, and the water pressing protrusion 41 is pressed against the surface of the flexible roller 10. When the flexible roller 10 rotates, the water pressing protrusion 41 presses the sewage in the flexible roller 10 into the sewage sink 24.

Embodiment 4

Figure 5:
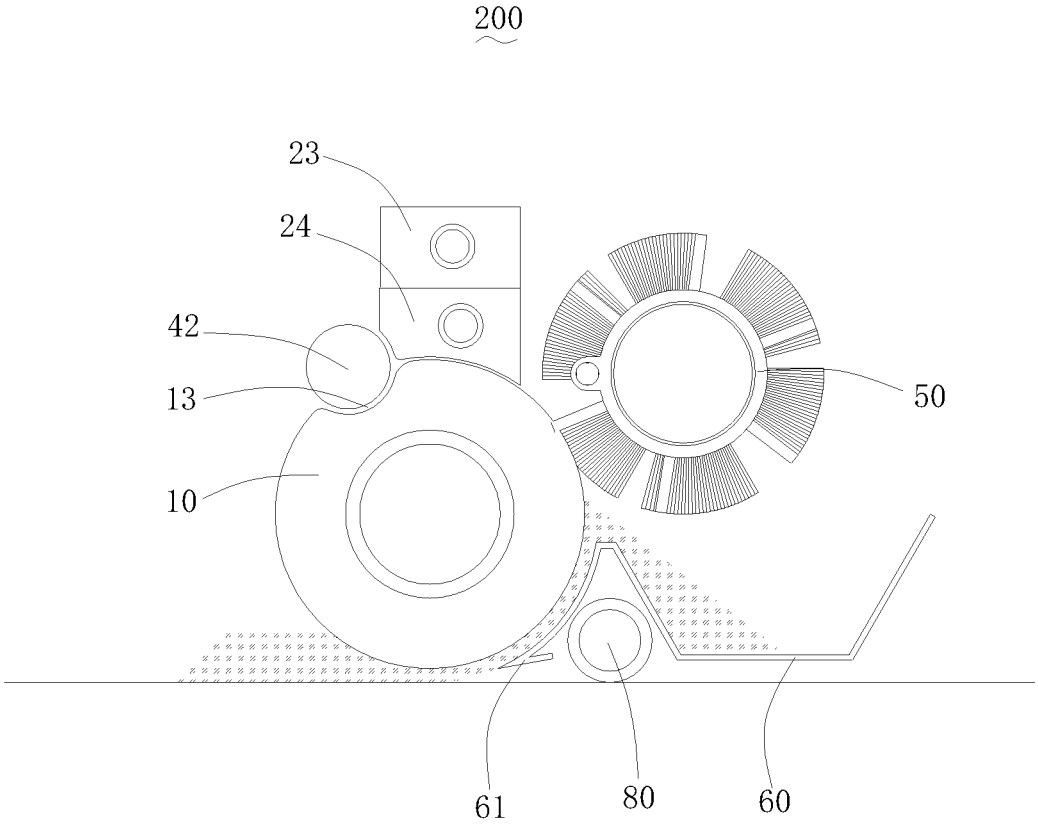
FIG. 5 is a schematic structural view of a roller cleaning device according to another preferred embodiment of the present disclosure, in which the water tank, the sewage pipe, and the clean water pipe are removed.

Referring to FIG. 5, the roller cleaning device 200 of this embodiment differs from the first embodiment in that the sewage sink 24 is disposed above the flexible roller 10, and the sewage sink 24 is provided with a sewage hole 26 at the bottom of the sewage sink 24. The clean water sink 23 is disposed above the sewage sink 24 and connected to the sewage sink 24. The clean water hole 25 is provided at the bottom of the clean water sink 23, and the clean water hole 25 is connected to the sewage sink 24. The clean water flows through the clean water sink 23 and the sewage sink 24 and to the flexible roller 10 at the bottom. It is also possible to separate clean water and sewage, but the effect is not as good as in the first embodiment.

Further, one end or both ends of the clean water sink 23 is connected to the water tank 30 through the clean water pipe 22. One end or both ends of the sewage sink 24 are connected to the water tank 30 through the sewage pipe 21. A clean water electromagnetic valve is arranged on the clean water pipe 22, and a sewage electromagnetic valve is arranged on the sewage pipe 21. The sewage pressing member 40 is a water pressing protrusion 41 disposed at the bottom of the sewage sink 24, and the sewage sink 24 is connected with a drive component for moving up and down. The clean water electromagnetic valve, the sewage electromagnetic valve, and the drive component are electrically connected and controlled. The controller controls the clean water electromagnetic valve to alternately open with the sewage electromagnetic valve and the drive component, so that the clean water sink 23 and the sewage sink 24 are separated in time to further ensure separation of the clean water from the sewage. For example, the sewage sink 24 is connected to the drive component. When the drive component is turned on to drive the sewage sink 24 to descend, the water pressing protrusion 41 at the bottom of the sewage sink 24 presses down the flexible roller 10, and the sewage electromagnetic valve is opened for discharging sewage. The clean water electromagnetic valve is closed at this time. When the discharging of sewage is complete, the drive component drives the sewage sink 24 to rise, causing the water-squeezing protrusion to no longer press the flexible roller 10, and the clean water electromagnetic valve opens to provide clean water to the flexible roller 10.

Of course, the sewage pressing member 40 may also be a water pressing roller 42 that is connected to the drive component. When the drive component is turned on, the water pressing roller 42 is lowered. The water pressing roller 42 presses the flexible roller 10, and the sewage electromagnetic valve is opened for sewage discharge. At this time, the clean water electromagnetic valve is closed. When the discharge of sewage ends, the drive component causes the water pressing roller 42 to rise so that the water pressing roller 42 does not press the flexible roller 10, and the clean water electromagnetic valve opens to provide clean water for the flexible roller 10.

Embodiment 5

The roller cleaning device of this embodiment differs from the first embodiment in that the sewage sink 24 and the clean water sink 23 are both disposed above the flexible roller 10, and the sewage sink 24 is adjacent and separated from the clean water sink 23. The bottom of the sewage sink 24 is provided with a sewage hole 26, and a clean water hole 25 is disposed at the bottom of the clean water sink 23, so that a certain separation effect can be achieved.

Embodiment 6

The roller cleaning device of this embodiment differs from the first embodiment in that the sewage sink 24 shares a water sink with the clean water sink 23. The sewage pressing member 40 is a water pressing protrusion 41 or a water pressing roller 42 disposed at the bottom of the sewage sink 24. The sewage pressing member 40 is connected to a drive component. One end of the water sink is connected to the water tank 30 through the clean water pipe 22, and the other end is connected to the water tank 30 through the sewage pipe 21. The clean water pipe is provided with a clean water electromagnetic valve, and the sewage pipe is provided with a sewage electromagnetic valve. The clean water electromagnetic valve, the sewage electromagnetic valve, and the drive component are all electrically connected to a controller. The controller controls the clean water electromagnetic valve to open at alternative intervals from the sewage electromagnetic valve and the drive component. This separates clean water and sewage in time. For example, when the water sink is connected to a drive component, when the drive component is turned on, the sewage pressing member 40 is lowered to press down on the flexible roller 10, and the sewage electromagnetic valve is opened for discharging. The clean water electromagnetic valve is closed at this time. When the sewage discharge ends, the drive component drives the sewage pressing member 40 to rise, causing the sewage pressing member 40 to no longer press on the flexible roller 10, and the clean water electromagnetic valve opens to supply the flexible roller 10 with clean water.

The above-mentioned embodiments are merely illustrative of several embodiments of the present disclosure, and the description thereof is more specific and detailed, but is not to be construed as limiting the scope of the invention. It should be noted that a number of variations and modifications may be made by those skilled in the art without departing from the spirit and scope of the invention. Therefore, the scope of protection of the present invention shall be subject to the appended claims.

The invention claimed is:

1. A roller cleaning device, comprising:
a flexible roller;
a roller motor for driving the flexible roller to rotate, a surface of the flexible roller close to and in communication with a water sink;
a water tank; and
a sewage pressing member, wherein:
the water tank is provided with a filter member,
one end of the water sink communicates with the water tank at a position above the filter member through a sewage pipe,
the other end of the water sink communicates with the water tank at a position below the filter member through a clean water pipe,
the water tank is connected to a vacuum pump,
the sewage pressing member squeezes sewage in the flexible roller into the water sink when the flexible roller rotates,
the water sink comprises a clean water sink and a sewage sink,
a bottom of the clean water sink is provided with a clean water hole,
a bottom of the sewage sink is provided with a sewage hole,
the clean water sink communicates with the clean water pipe, and
the sewage sink communicates with the sewage pipe.

2. The roller cleaning device according to claim 1, wherein:
the filter member comprises:
an outer filter mesh;
a suction member mounted in the outer filter mesh; and
a drain pipe in communication with the suction member,
an outer wall of the outer filter mesh is connected to an inner wall of the water tank,
the sewage pipe and the clean water pipe are both connected to the outer filter mesh,
the drain pipe extends from a lower end of the outer filter mesh and extends from the water tank, and
a sealing member is disposed at a junction of the drain pipe and the water tank.

3. The roller cleaning device according to claim 2, wherein the suction member is at least one of a sponge, activated carbon, zeolite, or resin.

4. The roller cleaning device according to claim 1, wherein:
an inner wall of the water tank is provided with a serrated water tank protrusion,
an outer wall of the filter member is provided with a serrated filter protrusion, and
the serrated filter protrusion is rotatable along the serrated water tank protrusion to adjust a mounting position of the filter member.

5. The roller cleaning device according to claim 1, wherein the sewage sink is provided separate from the clean water sink.

6. The roller cleaning device according to claim 1, wherein:
the clean water sink is disposed above the flexible roller,
the sewage sink is disposed adjacent to the clean water sink, and
the sewage pressing member is disposed adjacent to the sewage sink.

7. The roller cleaning device according to claim 1, wherein:
the sewage sink is disposed above the flexible roller,
the clean water sink is disposed above the sewage sink and connected to the sewage sink,
the sewage pressing member is connected to a drive component,
the clean water pipe is provided with a clean water electromagnetic valve,
the sewage pipe is provided with a sewage electromagnetic valve, and
the clean water electromagnetic valve and the sewage electromagnetic valve are electrically connected a controller that controls the clean water electromagnetic valve to alternately open with the sewage electromagnetic valve.

8. The roller cleaning device according to claim 1, wherein:
the sewage pressing member is a water pressing roller,
the water pressing roller is disposed adjacent to the water sink,
a center of the water pressing roller is disposed in parallel with a center of the flexible roller, and a surface of the water pressing roller is pressed against the surface of the flexible roller.

9. A cleaning robot comprising the roller cleaning device according to claim 1.

10. A roller cleaning device, comprising:

a flexible roller configured to be rotated;

a water sink for dispensing clean fluid onto the flexible roller and receiving sewage from the flexible roller;

a water tank, wherein:

the water tank is provided with a filter member, one end of the water sink communicates with the water tank at a position on a first side of the filter member through a sewage pipe, and the other end of the water sink communicates with the water tank at a position on a second side of the filter member opposite the first side through a clean water pipe;

a roller brush in contact with the flexible roller;

a garbage collection box under the roller brush;

a scraper between the garbage collection box and the flexible roller; and a load bearing wheel between the scraper and the garbage collection box.

11. The roller cleaning device of claim 10, comprising:

a sewage pressing member, wherein the sewage pressing member squeezes the sewage in the flexible roller into the water sink when the flexible roller rotates.

12. The roller cleaning device of claim 10, comprising:

a roller motor for driving the flexible roller to rotate, wherein the roller motor is disposed within the flexible roller.

13. The roller cleaning device of claim 10, wherein the water tank is connected to a vacuum pump.

14. The roller cleaning device of claim 10, wherein the water tank is above the water sink.

15. The roller cleaning device of claim 10, wherein the water sink is divided into a clean water sink and a sewage sink separate from the clean water sink.

16. A roller cleaning device, comprising:

a flexible roller;

a roller motor for driving the flexible roller to rotate, a surface of the flexible roller close to and in communication with a water sink;

a water tank; and a sewage pressing member, wherein:

the water tank is provided with a filter member, one end of the water sink communicates with the water tank at a position above the filter member through a sewage pipe, the other end of the water sink communicates with the water tank at a position below the filter member through a clean water pipe, the water tank is connected to a vacuum pump, the sewage pressing member squeezes sewage in the flexible roller into the water sink when the flexible roller rotates, an inner wall of the water tank is provided with a serrated water tank protrusion, an outer wall of the filter member is provided with a serrated filter protrusion, and the serrated filter protrusion is rotatable along the serrated water tank protrusion to adjust a mounting position of the filter member.

* * * * *